United States Patent [19]

Kenny et al.

[11] 4,067,523

[45] Jan. 10, 1978

[54] LATERALLY ADJUSTABLE ADAPTER BRACKET FOR A GRADE CROSSING GATE AND SIGNAL ASSEMBLY

[75] Inventors: John M. Kenny, Pittsburgh; Spiro J. Pappas, Verona, both of Pa.

[73] Assignee: Westinghouse Air Brake Company, Swissvale, Pa.

[21] Appl. No.: 770,675

[22] Filed: Feb. 22, 1977

[51] Int. Cl.[2] ..... B61L 29/04

[52] U.S. Cl. ..... 246/130; 246/125

[58] Field of Search ..... 246/125, 126, 127, 130, 246/292, 293; 49/124, 46, 141, 385; 248/282, 284

[56] References Cited

U.S. PATENT DOCUMENTS

| | | | |
|---|---|---|---|
| 2,137,196 | 11/1938 | Sampson | 246/130 |
| 2,598,196 | 5/1952 | Staley | 246/130 |
| 3,394,498 | 7/1968 | Reinitz | 49/141 |

FOREIGN PATENT DOCUMENTS

| | | | |
|---|---|---|---|
| 676,404 | 12/1963 | Canada | 246/130 |

*Primary Examiner*—Trygve M. Blix
*Assistant Examiner*—Reinhard J. Eisenzopf
*Attorney, Agent, or Firm*—J. B. Sotak; R. W. McIntire, Jr.

[57] ABSTRACT

An adjustable adapter bracket for a railroad-highway crossing gate and signal installation for permitting the elongated gate arm to be shifted laterally to avoid interference with overhead obstacles. The adapter bracket is fixedly attached to the ends of a pair of gate supporting arms and includes upper and lower U-shaped strut members each of which is provided with at least two longitudinal rows or lines of apertures. A breakaway gate arm connector including a pair of apertured mounting plates is selectively positioned along the length of the U-shaped strut member and is securely fastened thereto by a plurality of bolts and nuts. A plurality of reinforcing spacer members are positioned between and are bolted to the upper and lower U-shaped strut members to reinforce and strengthen the adapter bracket.

8 Claims, 4 Drawing Figures

LATERALLY ADJUSTABLE ADAPTER BRACKET FOR A GRADE CROSSING GATE AND SIGNAL ASSEMBLY

FIELD OF THE INVENTION

This invention relates to a railroad-highway crossing gate and signal assembly and, more particularly, to an adapter bracket which includes a pair of elongated multiple apertured reinforced strut members attached to a pair of counterweight gate supporting arms and arranged to permit the selective positioning of a gate arm connector whereby the elongated gate arm may be readily adjusted to avoid any possible interference with the superstructure of a grade crossing gate and signal apparatus.

BACKGROUND OF THE INVENTION

In order to afford maximum protection to vehicular traffic as well as to pedestrians at railroad-highway grade crossings, it is normal practice to provide a highway crossing gate and signal assembly which includes warning signs and a bell, flashing lights and a gate operating mechanism which moves an elongated gate arm between a vertical clear position and a horizontal traffic blocking position. However, many existing crossings are only provided with warning signs, or with warning signs, bell and flashing lights, or with warning signs, bell, flashing lights and operating mechanisms for actuating wooden gate arms for controlling oncoming traffic. Presently, there is a general trend to replace any of the aged and/or damaged wooden gate arms with a new version of lightweight gate arms that may be more readily and easily installed and that are not completely destroyed when a motor vehicle strikes the gate arm. It is also a common practice to install lightweight gate operating mechanisms on existing crossings which only had warning signs, or warning signs and bell and flashing lights. However, various problems have been encountered in attempting to replace wood gate arms with lightweight gate arms and to install lightweight gate operating mechanism on existing crossings. The existing railroad-highway crossing apparatus has never been standardized so that the dimensions and distances between the crossbuck signs and the flashing lights as well as between the flashing lights themselves and the supporting masts or poles greatly vary from one crossing installation to any other. Thus, the clearances between a vertically positioned gate arm and the superstructure at each highway crossing installation had to be thoroughly examined and considered in order to insure that a gate arm would not strike any of the overhead warning signal devices. In the past, special adapters and bracket assemblies had to be individually designed and used for each distinct and different crossing installation due to the great number of variations which could occur with previously installed equipment. Further, it was virtually impossible to predict whether an operating mechanism could even be mounted at a convenient height to facilitate maintenance. It will be appreciated that the particular height that the operating mechanism is mounted from the level of the ground is determined by the required offset dimension which is the distance measured from the center of the upstanding mast and the center of the gate arm when it is in its vertical clear position. It is well known that the smaller the offset, the lower to the ground level the operating mechanism may be mounted; however, there are instances when the vertical gate arm cannot clear overhead obstacles without increasing the offset more than would ordinarily or conveniently be used. It has been found that a great many of the previous problems could be resolved and any increase in the offset could be minimized if the gate arm could be selectively moved and laterally positioned to avoid any overhead obstacle or superstructure.

OBJECTS OF THE INVENTION

Accordingly, it is an object of this invention to provide a unique adapter bracket which permits a gate arm to be selectively moved in a lateral direction to avoid an overhead obstacle in a highway grade crossing gate and signal installation.

A further object of this invention is to provide a novel adjustable adapter bracket assembly for a lightweight highway gate operating mechanism.

Another object of this invention is to provide an improved adapter bracket for a railroad-highway grade crossing installation which allows the gate arm to be shifted laterally so that interference with the superstructure may be avoided when the gate arm is in its vertical clear position.

Yet a further object of this invention is to provide a laterally adjustable bracket including reinforced multiple aperture strut members attached to gate supporting arms and having a gate arm connector channel member may be selectively moved to prevent contact with the sign and signal apparatus of a grade crossing gate and signal installation.

Yet another object of this invention is to provide a highway crossing gate and signal assembly with an adjustable adapter bracket which allows the replacement of a wood gate arm with a lightweight aluminum gate arm at an existing installation.

Still another object of this invention is to provide an adapter bracket for allowing a gate arm to be adjustably positioned to permit the gate arm to avoid and clear the superstructure of a highway crossing gate and signal assembly having a pair of strut members each of which has at least two lateral rows of apertures; the pair of strut members are connected at their respective ends to a pair of gate supporting arms; spacer members are positioned in alignment with selected ones of the lateral rows of apertures and are securely fastened to the pair of the strut members, and a gate arm connecting means selectively aligned with certain ones of the lateral rows of the apertures to permit the gate arm to be securely mounted at various locations along the length of the pair of the strut members.

Still a further object of this invention is to provide a new and improved grade crossing gate arm adapter bracket which is economical in cost, simple in construction, easy to install, facile to adjust, reliable in operation, dependable in service, durable in use and efficient in operation.

SUMMARY OF THE INVENTION

In accordance with the present invention, there is provided an adjustable metal gate arm adapter bracket for use in a railroad-highway grade crossing gate and signal assembly. The adapter bracket includes a pair of elongated channel strut members each of which has at least two lateral rows of apertures extending the length thereof. Each of the respective ends of the elongated channel members is bolted to one leg of an angle iron while the other leg of each of the angle irons is bolted to a pair of gate supporting arms. A plurality of spacer members are positioned in alignment with selected ones of the apertures formed in the elongated street members and are bolted thereto to reinforce the elongated strut members against torsional distortion. A C-shaped gate arm connector member is arranged to releasably retain the elongated tubular aluminum gate arm. The C-shaped gate arm connector member has a pair of apertured mounting plates securely fastened to one end thereof. The apertured mounting plates are suitably located along the length of the elongated channel strut members and are bolted in place. The apertures in the mounting plates are selectively aligned with certain one of the apertures in the lateral rows to permit the aluminum gate arm to be located at various positions along the length of the pair of the elongated channel strut members to avoid interferring with the superstructure or overhead objects of the crossing gate and signal assembly.

BRIEF DESCRIPTION OF THE DRAWINGS

The foregoing objects and other attendant features and advantages will be more readily apparent and appreciated as the subject invention becomes more clearly understood by reference to the following detailed description when considered in conjunction with the accompanying drawings wherein.

DESCRIPTION OF THE PREFERRED EMBODIMENT

Figure 1:
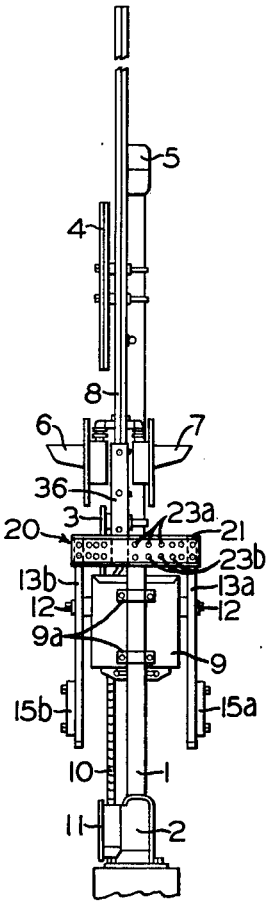
FIG. 1 is an end elevational view looking from the center of the highway of a complete railroad-highway grade crossing gate and signal assembly employing the present invention with the gate arm in its vertical non-obstructing or clear position.
Figure 2:
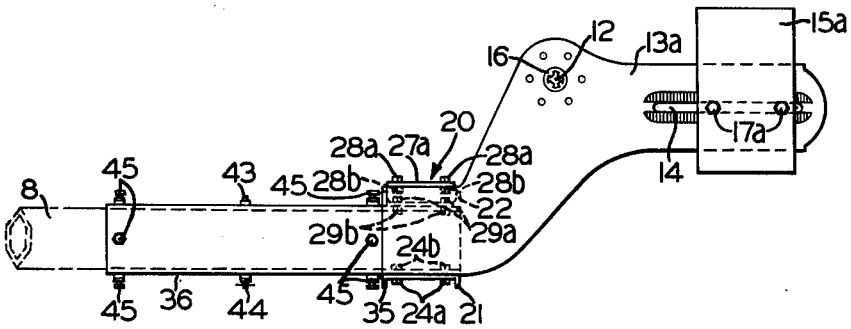
FIG. 2 is an enlarged fragmentary side elevational view of the gate supporting arrangement in accordance with the present invention with the gate arm in its horizontal obstructing position.
Figure 3:
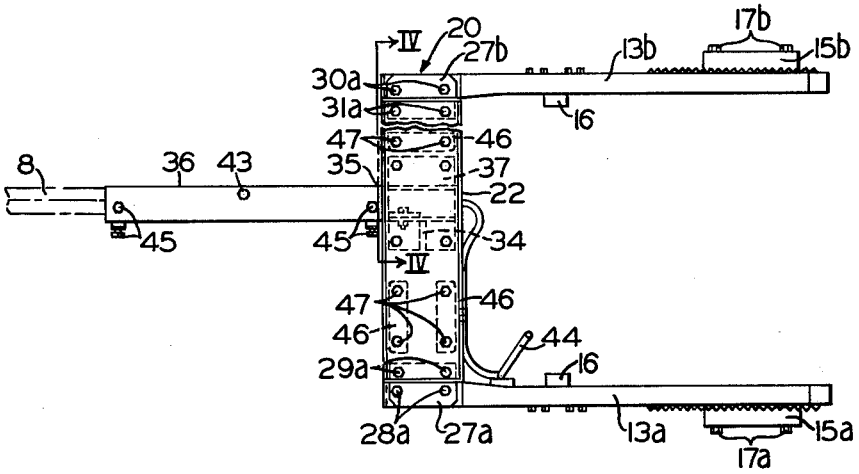
FIG. 3 is a top plan view of the gate supporting arrangement of FIG. 1.
Figure 4:
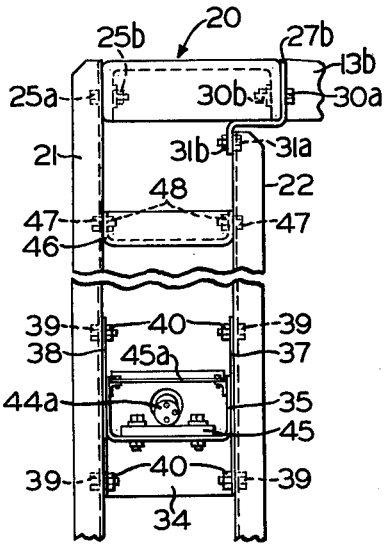
FIG. 4 is a partial enlarged cross-sectional view taken along lines IV—IV of FIG. 3.

Referring now to the drawings, and in particular to FIG. 1, there is shown a complete railroad-highway crossing gate and signal installation for warning motorists and pedestrians of approaching trains. A pole or mast 1 having a base 2 is securely fastened by anchor bolts or the like to a suitable concrete foundation which is located along side of the roadway at the crossing site. The mast 1 supports and carries the customary warning devices, such as, a "stop on red signal" sign 3, a pair of cross arms 4 bearing the designation "railroad crossing," an audible signal in the form of a bell 5 and two pairs of flashing lamps 6 and 7 which emit visual signals. The mast 1 also supports and carries a gate operating mechanism 9 which moves an elongated lightweight gate arm 8 between a horizontal traffic obstructing or blocking position and a vertical nonobstructing or clear position as shown in FIG. 1. As shown, the gate mechanism 9 is mounted to mast 1 by means of clamps and bolts 9*a* located near the top and bottom of the metal housing of mechanism 9. It will be appreciated that an electric motor, a gear train, an output shaft, a circuit control, a hold clear brake, etc., are suitably mounted and housed within the metal case of mechanism 9. The gate mechanism 9 may be of the type described in U.S. Application Ser. No. 770,523, filed Feb. 2, 1977, by Spiro J. Pappas, entitled "Grade Crossing Assembly." The motor is powered by a suitable source of electric voltage which is conveyed to housing 9 via flexible conduit 10 from junction box 11. The ends of the main output shaft 12 extend out of the sides of housing 9 and are adapted to carry a pair of gate supporting arms 13*a* and 13*b*. Each of the arms 13*a* and 13*b* is an aluminum casting having a circular hole located at substantially its center of gravity for fitting on the ends of shaft 12. As shown in FIGS. 2 and 3, an internally splined steel insert 16 fitted in the hole in each gate supporting arm and is attached in place by six bolts (not characterized). The arms 13*a* and 13*b* are fitted onto inserts 16 and held in place by suitable locking nuts and washers. The aluminum gate supporting arms each includes a heel portion which includes a slot or elongated aperture 14 for accommodating a counterweight 15*a* and 15*b*. The counterweights are selectively bolted to the arms by a pair of bolts and nuts 17*a* and 17*b* which pass through two holes or apertures in the counterweights and also slot 14 in the arms. Thus, the counterweights may be shifted to the right or left to offset or counterbalance the weight of the gate arm as viewed in FIG. 2. The other end or toe portion of each of the cast aluminum gate supporting arms 13*a* and 13*b* are arranged to receive a gate arm adapter bracket 20.

As shown in the drawings, the adjustable adapter bracket 20 includes an upper and a lower elongated strut member 21 and 22 which span and are attached to the toe portions of gate supporting arms 13*a* and 13*b*. The lower strut member 21 takes the form of an elongated U-shaped channel having two series or rows of aligned holes or apertures 23*a* and 23*b* extending along the length thereof. The outer two end holes of each of the rows 23*a* and 23*b* of channel 21 are arranged to be in alignment with two holes formed in the bottom end of gate supporting arms 13*a* and 13*b*, respectively. As shown, a pair of bolts 24*a* and 24*b* are inserted into the two end holes and are held in place by suitable locking nuts 24*b*. Similarly, a pair of bolts 25*a* are inserted into the two end bolts formed in the other end of strut member 21 for attachment to gate supporting arm 13*b*. Locking nuts 25*b* are threaded onto the bolts 25*a* to securely hold the member 21 onto the bottom of gate support arm 13*b*. The upper strut member 22 which also takes the form of an elongated U-shaped channel member 22 is also attached to gate supporting arms 13*a* and 13*b* by a pair of Zee mounting braces 27*a* and 27*b*, respectively. One leg of Zee brace 27*a* is bolted to the top surface of the toe portion of arm 13 by bolts 28*a* and locking nuts 28*b*. The two end holes of channel 22 are aligned with two holes formed in the other leg of Zee member 27*a* and are bolted together by bolts 29*a* and locking nuts 29*b*. Similarly one leg of the Zee member 27*b* is securely fastened to the top edge of arm 13*b* by bolts and nuts 30*a*, 30*b* while the other leg of Zee 27*b* is attached to channel member 22 by bolts and nuts 31*a*, 31*b*.

It will be seen that a breakaway type of gate arm connector 35 is selectively laterally positioned between and along the longitudinal axis or length of the upper and lower channel members 21 and 22. As shown, the connector 35 includes a C or U-shaped channel member 36 which has welded to one end thereof a pair of rectangular mounting plates 37 and 38. The upper mounting plate 37 includes four holes one located in each corner, which are aligned with selected ones of four holes in the upper channel strut member 22. Likewise, the lower mounting plate 38 includes four holes, one located in each corner, which are aligned with selected one of four holes in the lower channel strut member 21. A reinforcing plate 34 is located between and is welded to the upper and lower mounting plates 37 and 38. It will be noted that the mounting plates 37 and 38 are rigidly attached to the respective channel strut members 22 and 21 by bolts and locking nuts 39 and 40, respectively. An electrical cable 44 supplies power to an electrical coupler 44*a* which is housed within the end of U-shaped channel 36 and is attached to a support plate 45 which is bolted to the channel member 36. A cover plate 45*a* is disposed over the open side of channel 36 and is attached thereto by suitable screws (not characterized). The elongated tubular aluminum gate arm 8 is releasably attached to the channel member 36. As shown in FIG. 2, the lightweight aluminum gate arm 8 is hexagonal in cross-section and a shear pin or bolt 43 is the sole means for connecting the arm 8 to connector channel member 36. The shear pin or bolt 43 is made of aluminum or other suitable material and is notched out near both ends to form neck portions of reduced diameter from the shank portion. The channel member 36 and gate arm are provided with holes through which the shear pin 43 passes and a locking nut 44 is screwed on the lower threaded end. The channel member 36 includes six raised threaded means or nuts for accommodating snug bolts 45 which are finger tightened to remove any wobble and end play existing between the arm and channel member. After the breakaway connector 35 is bolted in place, a plurality of dish-like spacer members 46 (three being shown in phantom in FIG. 3) are discretely positioned and attached to the upper and lower strut channels 21 and 22 by bolts 47 and nuts 48. The reinforcing spacers 46 increase the rigidity of the structure and prevent bending moments from distorting the structure.

In viewing FIGS. 1 and 3, it will be noted that the connector 36 and, in turn, the gate arm is adjusted and positioned slightly to the left of the center in order to avoid overhead obstacles, such as, the warning signs and flashing lamps. Since there are dimensional variations and numerous types of brackets and supports which are used to affix the crossbuck and warning signs and the flashing lamps to the mast, it is highly advantageous to provide an adjustable adapter bracket which permits the gate arm to be selectively laterally moved along the length of the strut members 21 and 22 in order for the gate arm to miss and avoid the superstructure when it assumes its vertical clear or nonobstructing position as shown in FIG. 1. This lateral adjustment alleviates the need of larger offset distances, namely, the distance from the center line of the mast to the center line of a vertical gate arm, which results in the elimination of gate supporting arm extensions and avoids the need of selecting one of a number of various adapters for each different type of grade crossing installation. In the present invention, the aluminum gate arm 8 may be easily and quickly shifted laterally along the entire length of the strut members 21 and 22 to avoid any interference with the overhead structure as well as to prevent contact with suspended electrical power and telephone lines.

It will be appreciated that various changes, modifications and alleviations may be made by those skilled in the art without departing from the spirit and scope of the present invention. For example, the two rows of circular holes in C or U-shaped member 21 and 22 may take the form of a series of elongated slots, and the Zee braces 27*a* and 27*b* and box-like spacers 46 may be replaced by other equivalent elements which have the same function to produce the same results. Thus, it will be understood that various substitutes and different elements may be employed in practicing the present invention and, therefore, it is realized that all changes, equivalents and mutations within the spirit and scope of the present invention are meant to be covered by the appended claims.

Having now described the invention, what we claim as new and desire to secure by Letters Patent, is:

1. An adapter bracket for allowing an elongated gate arm to be adjustably positioned to permit the gate arm to clear the superstructure of a highway crossing gate and signal assembly comprising, a pair of strut members each having at least two rows of apertures, said pair of strut members connectable at their respective ends to a pair of gate supporting arms, spacer members positioned in alignment with selected ones of said rows of said apertures and securely fastened to said pair of said strut members, and a gate arm connecting means selectively aligned with chosen ones of said rows of said apertures to permit the gate arm to be securely mounted at various locations along the length of said pair of said strut members.

2. The adapter bracket as defined in claim 1, wherein each of said strut members is an elongated channel.

3. The adapter bracket as defined in claim 2, wherein the ends of one of said elongated channels are connected to said pair of gate supporting arms by means of Zee brackets.

4. The adapter bracket as defined in claim 1, wherein said gate arm connecting means includes an elongated C-shaped channel.

5. The adapter bracket as defined in claim 1, wherein said spacer members reinforce said strut members against twisting moments exerted by said elongated gate arm.

6. The adapter bracket as defined in claim 1, wherein said gate arm connecting means includes a pair of apertured mounting plates each of which is bolted to said pair of said strut members.

7. The adapter bracket as defined in claim 1, wherein said gate supporting arms have counterweights to offset the weight of the gate arm.

8. The adapter bracket as defined in claim 1, wherein said gate arm connecting means includes a support plate for accommodating a breakaway electrical connector.

* * * * *